US010276097B2

(12) United States Patent
Duan et al.

(10) Patent No.: US 10,276,097 B2
(45) Date of Patent: Apr. 30, 2019

(54) PIXEL CIRCUIT, DRIVING CIRCUIT, ARRAY SUBSTRATE AND DISPLAY DEVICE

(71) Applicant: BOE TECHNOLOGY GROUP CO., LTD., Beijing (CN)

(72) Inventors: Liye Duan, Beijing (CN); Lirong Wang, Beijing (CN); Zhongyuan Wu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 276 days.

(21) Appl. No.: 14/366,865

(22) PCT Filed: Dec. 12, 2013

(86) PCT No.: PCT/CN2013/089155
§ 371 (c)(1),
(2) Date: Jun. 19, 2014

(87) PCT Pub. No.: WO2015/032145
PCT Pub. Date: Mar. 12, 2015

(65) Prior Publication Data

US 2016/0163263 A1 Jun. 9, 2016

(30) Foreign Application Priority Data

Sep. 9, 2013 (CN) ..... 2013 1 0407319

(51) Int. Cl.
*G09G 3/3283* (2016.01)
*G09G 3/325* (2016.01)
*G09G 3/3258* (2016.01)

(52) U.S. Cl.
CPC ..... *G09G 3/3258* (2013.01); *G09G 3/325* (2013.01); *G09G 3/3283* (2013.01);
(Continued)

(58) Field of Classification Search
CPC ..... G09G 3/3258; G09G 3/3283; G09G 2310/0264; G09G 2320/043;
(Continued)

(56) References Cited

U.S. PATENT DOCUMENTS 7,417,607 B2 8/2008 Miyazawa
8,284,124 B2 10/2012 Kim et al.
(Continued)

FOREIGN PATENT DOCUMENTS

CN 1584963 A 2/2005
CN 101097681 A 1/2008
(Continued)

OTHER PUBLICATIONS

English translation of the International Preliminary Report on Patentability and Written Opinion of the International Searching Authority of PCT/CN2013/089155, dated Mar. 15, 2016.
(Continued)

*Primary Examiner* — Patrick N Edouard
*Assistant Examiner* — Douglas M Wilson
(74) *Attorney, Agent, or Firm* — Collard & Roe, P.C.

(57) ABSTRACT

The present disclosure relates to the OLED display technology. There are provided a pixel circuit, a driving circuit, an array substrate and a display device, which are supplied with the voltage by the light emitting operation voltage when the pixel circuit enters the light emitting stage, by inputting an inverse signal synchronized with the pre-charging control voltage at the input terminal of the light emitting operation voltage to ensure a stable output of the current by the circuit at the light emitting stage. Also, it does not require an arrangement of an external voltage input terminal which will affect the aperture ratio, thereby increasing the aperture ratio of the OLED employing the current-driven pixel circuit while ensuring the stable output of the current by the
(Continued)

current-driven circuit, and thus increasing the lifetime of the OLED employing the current-driven pixel circuit.

16 Claims, 8 Drawing Sheets

(52) U.S. Cl.
CPC ..... *G09G 2300/0465* (2013.01); *G09G 2300/0809* (2013.01); *G09G 2300/089* (2013.01); *G09G 2300/0819* (2013.01); *G09G 2300/0842* (2013.01); *G09G 2300/0861* (2013.01); *G09G 2300/0866* (2013.01); *G09G 2310/0251* (2013.01); *G09G 2310/0264* (2013.01); *G09G 2320/043* (2013.01)

(58) Field of Classification Search
CPC ... G09G 2300/0809; G09G 2310/0251; G09G 3/325; G09G 2300/0465; G09G 3/3241; G09G 2300/0866; G09G 2300/089; G09G 2300/0861; G09G 2300/0842; G09G 2300/0819
See application file for complete search history.

(56) References Cited

U.S. PATENT DOCUMENTS 8,314,756 B2 * 11/2012 Rankov ..... G09G 3/3233 257/261
8,760,374 B2 * 6/2014 Osame et al. ..... G09G 3/3241 345/82
8,791,887 B2 * 7/2014 Smith ..... G09G 3/3283 345/78
2004/0150593 A1 8/2004 Yen et al.
2006/0022605 A1 2/2006 Ha et al.
2006/0066254 A1 * 3/2006 Sasaki ..... G09G 3/3233 315/169.3
2006/0139264 A1 * 6/2006 Choi ..... G09G 3/3283 345/76
2007/0126680 A1 * 6/2007 Han ..... G09G 3/3233 345/92
2007/0182671 A1 * 8/2007 Nathan ..... G09G 3/3241 345/76
2008/0297056 A1 * 12/2008 Hirai ..... G09G 3/3241 315/169.3
2009/0278834 A1 11/2009 Tomida et al.
2010/0053041 A1 3/2010 Abe et al.
2010/0225770 A1 9/2010 Morimoto et al.
2012/0287103 A1 11/2012 Wu et al.
2014/0320555 A1 * 10/2014 Hekmatshoartabari ..... G09G 3/3258 345/691

FOREIGN PATENT DOCUMENTS

CN 101577085 A 11/2009
CN 101667391 A 3/2010
CN 102646386 A 8/2012
CN 203520833 U 4/2014

OTHER PUBLICATIONS

English Translation of the International Search Report of PCT/CN2013/089155 published in English dated Mar. 12, 2015.
Patent Grant Notification for the priority application CN 201310407319.1 filed on Sep. 9, 2013 which issued as Chinese Patent 2014101500454800 dated Oct. 31, 2014 in Chinese.
Patent Grant Notification for the priority application CN 201310407319.1 filed on Sep. 9, 2013 which issued as Chinese Patent 2014101500454800 dated Oct. 31, 2014 in English.
Chinese Office Action of Chinese Application No. 201310407319.1 with English translation, dated Jul. 21, 2014.
International Search Report, International Preliminary Report on Patentability and Written Opinion of the International Searching Authority of PCT/CN2013/089155 in Chinese, dated Jun. 4, 2014.

* cited by examiner

PIXEL CIRCUIT, DRIVING CIRCUIT, ARRAY SUBSTRATE AND DISPLAY DEVICE

CROSS REFERENCE TO RELATED APPLICATIONS

This application is the National Stage of PCT/CN2013/089155 filed on Dec. 12, 2013, which claims priority under 35 U.S.C. § 119 of Chinese Application No. 201310407319.1 filed on Sept. 9, 2013, the disclosure of which is incorporated by reference.

TECHNICAL FIELD OF THE DISCLOSURE

The present disclosure relates to the technical field of organic light emitting display, and particularly to a pixel circuit, a driving circuit, an array substrate and a display device.

BACKGROUND

The driving methods for an Organic Light Emitting Display (OLED) pixel circuit may be divided into a current-driven method and a voltage-driven method. FIG. 1 shows a voltage-driven pixel circuit, and FIG. 2 shows a current-driven pixel circuit. In the voltage-driven pixel circuit, the formula for the output current $I_{OLED}$ is as follows:

$$I_{OLED} = \frac{1}{2}\mu_n \cdot \mathrm{Cox} \cdot \frac{W}{L} \cdot (Vdata - Voled - Vth)^2,$$

where $\mu_n$ is a carrier mobility, $C_{ox}$ is a gate oxide capacitance, W/L is a width-to-length ratio of a transistor, Vdata is a data voltage, Voled is an OLED light emitting operation voltage shared by all pixel units, and Vth is a threshold voltage of the transistor. For an enhancement-type Thin Film Transistor (TFT), Vth is a positive value. For a depletion-type TFT, Vth is a negative value. It can be known that if Vth of a pixel varies with time, the output current $I_{OLED}$ of the pixel at different times will be different. The afterimage phenomenon will occur, and a stable display of an Organic Light Emitting Diode (OLED) display temporally cannot be ensured. The advantage of the current-driven method with respect to the voltage-driven method is that the output current $I_{OLED}$ is always equal to the input current $I_{data}$. In the current-driven pixel circuit, even if the threshold voltage Vth of the pixel varies with time, the current-driven pixel circuit can adjust autonomously to ensure that the output current $I_{OLED}$ is always equal to the input current $I_{data}$, so as to realize a uniform display spatially and a stable display temporally of the OLED. This is because that the operation process of the current-driven pixel circuit may generally be divided into two stages, the first of which is a pre-charging stage, and the second of which is a light emitting stage. At the pre-charging stage, the output current $I_{OLED}$ is equal to the input current $I_{data}$, at the same time, charge is stored in a capacitor of the current-driven pixel circuit. At the light emitting stage, since the charge has been stored in the capacitor of the current-driven pixel circuit, it can be ensured that the output current $I_{OLED}$ in the current-driven pixel circuit is still equal to the output current $I_{OLED}$ at the pre-charging stage, i.e., still equal to the input current $I_{data}$ at the pre-charging stage. A particular current-driven pixel circuit is as shown in FIG. 3, in the circuit, there is an input terminal of an external control voltage Vctrl for supplying the voltage to the circuit in the light emitting stage, which is connected to a gate of a TFT, and an input terminal of an operation voltage VDD of the circuit is connected to one of a source and a drain of the TFT. A simulated signal waveform chart of the circuit is as shown in FIG. 4. An inverse signal synchronized with the signal input from the input terminal of a pre-charging control voltage Vselect for supplying the voltage to the circuit in the pre-charging stage is input from the input terminal of the external control voltage Vctrl, to realize a supply of voltage to the driving circuit by the pre-charging control voltage Vselect in the pre-charging stage, and a supply of voltage to the circuit by a voltage combined by the external control voltage Vctrl and the operation voltage VDD through a TFT connected thereto, ensuring the output current $I_{OLED}$ of the current-driven pixel circuit existing in the light emitting stage. However, the existence of the external Vctrl input terminal will decrease the aperture ratio of the pixels. With the decrease of the aperture ratio of the pixels, the lifetime of the OLED is decreased.

SUMMARY

There provide a pixel circuit, a driving circuit, an array substrate and a display device in embodiments of the present disclosure to prolong the lifetime of the OLED employing the current-driven pixel circuit.

There is provided a pixel circuit comprising: a first thin film transistor whose gate is connected to an input terminal of a pre-charging control voltage and a current input terminal, and drain is connected to the input terminal of the pre-charging control voltage, the current input terminal and an input terminal of a light emitting operation voltage for inputting an inverse signal synchronized with the pre-charging control voltage; a capacitor whose two ends are connected to a source and the gate of the first thin film transistor, respectively; and an organic light emitting diode whose positive pole is connected to the source of the first thin film transistor, and negative pole is connected to an input terminal of a ground voltage.

Optionally, the drain of the first thin film transistor is connected to the input terminal of the light emitting operation voltage through a diode.

Optionally, the drain of the first thin film transistor is connected to the input terminal of the light emitting operation voltage through a second thin film transistor; a gate and one of a source and a drain of the second thin film transistor are connected to the input terminal of the light emitting operation voltage, and the other one of the source and the drain is connected to the drain of the first thin film transistor.

Optionally, the gate and/or the drain of the first thin film transistor is connected to the input terminal of the pre-charging control voltage and the current input terminal through a thin film transistor operating as a switch.

Optionally, the gate of the first thin film transistor is connected to the input terminal of the pre-charging control voltage and the current input terminal, through a third thin film transistor whose gate is connected to the input terminal of the pre-charging control voltage, one of source and drain is connected to the gate of the first thin film transistor, and the other one of source and drain is connected to the current input terminal; and/or the drain of the first thin film transistor is connected to the input terminal of the pre-charging control voltage and the current input terminal, through a fourth thin film transistor whose gate is connected to the input terminal of the pre-charging control voltage, one of source and drain is connected to the drain of the first thin film transistor, and the other one of source and drain is connected to the current input terminal.

A driving circuit comprises multiple pixel circuits provided in the embodiments of the present disclosure, the multiple pixel circuits provided in the embodiments of the present disclosure being formed in a matrix; wherein the pixel circuits in the same row of the matrix among the multiple pixel circuits provided in the embodiments of the present disclosure are connected to the same input terminal of the light emitting operation voltage, and are connected to the same input terminal of the pre-charging control voltage; and the pixel circuits in the same column of the matrix among the multiple pixel circuits provided in the embodiments of the present disclosure are connected to the same current input terminal.

There is provided an array substrate comprising the driving circuit provided in the embodiments of the present disclosure.

There is provided a display device comprising the driving circuit provided in the embodiments of the present disclosure.

There provide in the embodiments of the present disclosure the pixel circuit, the driving circuit, the array substrate and the display device, which are supplied with the voltage by the light emitting operation voltage when the pixel circuit enters the light emitting stage, by inputting an inverse signal synchronized with the pre-charging control voltage at the input terminal of the light emitting operation voltage to ensure a stable output of the current by the circuit in the light emitting stage. Also, it does not require an arrangement of an external voltage input terminal which will decrease the aperture ratio, thereby increasing the aperture ratio of the OLED employing the current-driven pixel circuit while ensuring the stable output of the current by the current-driven circuit, and thus increasing the lifetime of the OLED employing the current-driven pixel circuit.

DETAILED DESCRIPTION

There provide in the embodiments of the present disclosure a pixel circuit, a driving circuit, an array substrate and a display device, which are supplied with the voltage by the light emitting operation voltage when the pixel circuit enters the light emitting stage, by inputting an inverse signal synchronized with the pre-charging control voltage Vselect at the input terminal of the light emitting operation voltage. It ensures a stable output of the current by the circuit in the light emitting stage. Also, it does not require an arrangement of an external voltage input terminal which will decrease the aperture ratio, thereby increasing the aperture ratio of the OLED employing the current-driven pixel circuit while ensuring the stable output of the current by the current-driven circuit, and thus increasing the lifetime of the OLED employing the current-driven pixel circuit.

Figure 1:
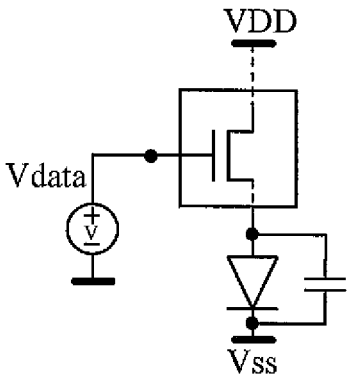
FIG. 1 is a diagram of a voltage-driven pixel circuit as known in the art.
Figure 2:
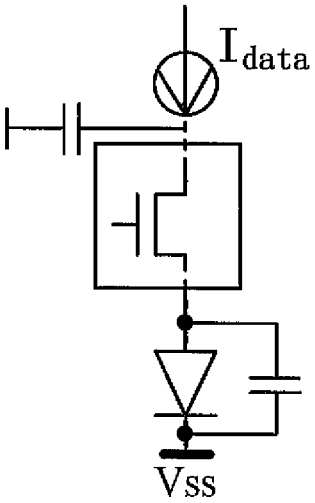
FIG. 2 is a diagram of a current-driven pixel circuit as known in the art.
Figure 3:
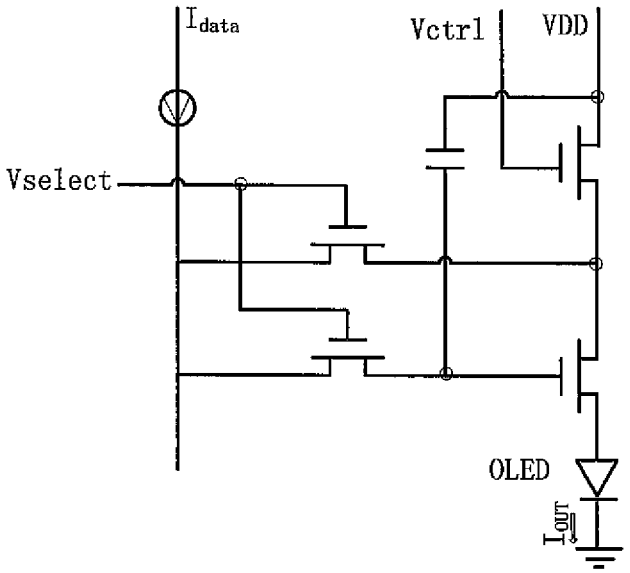
FIG. 3 is a diagram of a particular current-driven pixel circuit as known in the art.
Figure 4:
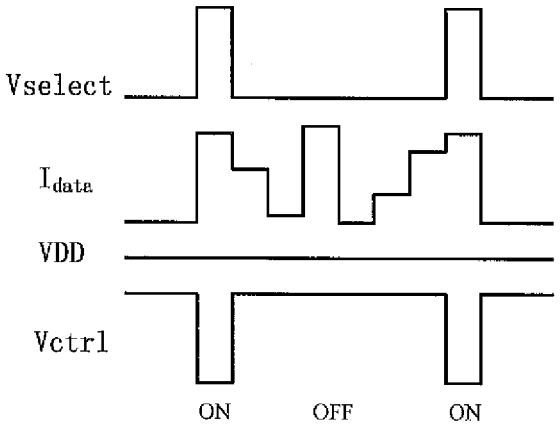
FIG. 4 is a simulated signal waveform chart of the current-driven pixel circuit in the prior art.
Figure 5:
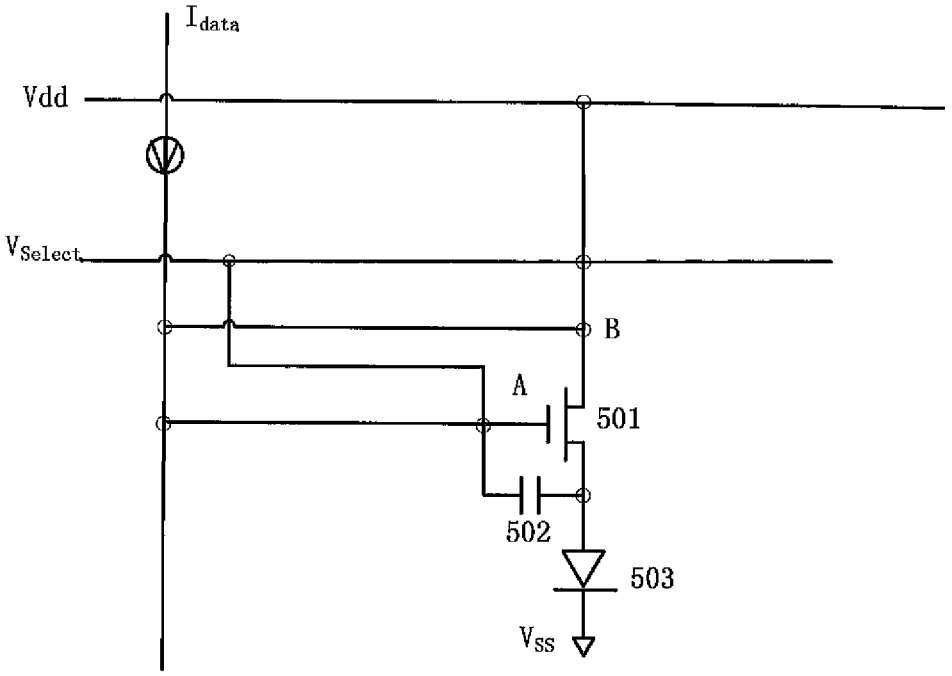
FIG. 5 is a schematic diagram of a pixel circuit in a first embodiment of the present disclosure.

As shown in FIG. 5, a pixel circuit according to a first embodiment of the present disclosure comprises:

a first thin film transistor (TFT) 501, whose gate is connected to an input terminal of a pre-charging control voltage Vselect and a current input terminal, and drain is connected to the input terminal of the pre-charging control voltage Vselect, the current input terminal and an input terminal of a light emitting operation voltage Vdd for inputting an inverse signal synchronized with the pre-charging control voltage Vselect;

a capacitor 502, having two ends being connected to a source and the gate of the first TFT 501, respectively; and an organic light emitting diode (LED) 503 whose positive pole is connected to the source of the first TFT 501, and negative pole is connected to an input terminal of a ground voltage Vss.

An inverse signal synchronized with the pre-charging control voltage Vselect is input from the input terminal of the light emitting operation voltage Vdd. Therefore, the circuit is supplied with the voltage by the signal input from the input terminal of the pre-charging control voltage Vselect in the pre-charging stage, and is supplied with the voltage by the signal input from the light emitting operation voltage Vdd in the light emitting stage thereby, it is ensured that there is current output in the circuit in the light emitting stage, while the capacitor 502 ensures that the current output in the light emitting stage is the same as that in the pre-charging stage. There is no external signal terminal in the circuit which will affect the aperture ratio, thereby increasing the aperture ratio of the OLED employing the current-driven pixel circuit, and thus increasing the lifetime of the OLED employing the current-driven pixel circuit.

In the practical application, the drain voltages of the first TFTs 501 of the adjacent pixels will be different when the currents input from the current input terminals of the adjacent pixels in the same row are different, which easily results in the direction of the current in the driving circuit for a pixel with a higher drain voltage is opposite to the direction of the current required in a normal operation, thereby affecting a normal display of the OLED. Therefore, in order to prevent the direction of the current in the driving circuits for the respective pixels from being opposite to the direction of the current required in the normal operation, the drain of the first TFT 501 in the pixel circuit can be connected to the input terminal of the light emitting operation voltage Vdd through a diode to ensure that the current of the driving circuit in the light emitting stage is flowed to the drain of the first TFT 501 from the input terminal of the driving voltage.

Alternatively, for convenience of the manufacture of the OLED, the diode connecting the drain of the first TFT 501 and the input terminal of the light emitting operation voltage Vdd can be replaced with a TFT.

Figure 6:
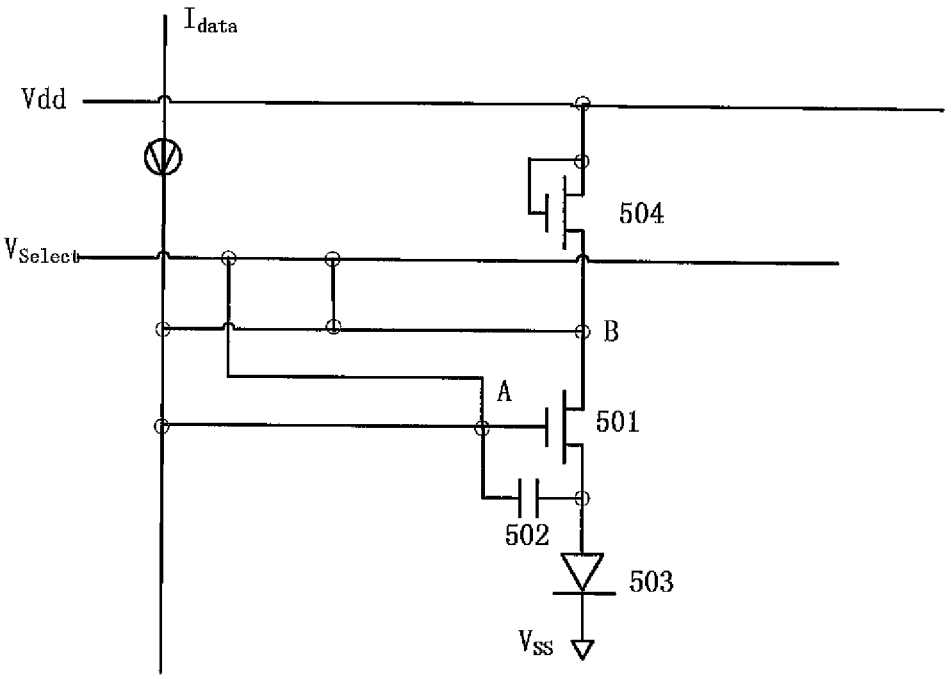
FIG. 6 is a schematic diagram of a pixel circuit in a second embodiment of the present disclosure.

FIG. 6 shows a pixel circuit in the second embodiment of the present disclosure schematically. Specifically, as shown in FIG. 6, the drain of the first TFT 501 can be connected to the input terminal of the light emitting operation voltage Vdd through a second TFT 504.

A gate and one of a source and a drain of the second TFT 504 are connected to the input terminal of the light emitting operation voltage Vdd, and the other one of the source and the drain is connected to the drain of the first TFT 501.

The second TFT 504 in FIG. 6 may be viewed as a diode with a positive pole connected to the input terminal of the light emitting operation voltage Vdd and a negative pole connected to the drain of the first TFT 501, thereby ensuring that the direction of the current in the driving circuit is from the input terminal of the light emitting operation voltage Vdd to the drain of the first TFT 501.

Of course, those skilled in the art may employ other feasible ways to prevent the currents input from the current input terminals of the adjacent pixels in the same row from being different and thus affecting the normal display of the OLED. The implementation provided herein is only exemplary and the other implementations will not be described in detail one by one.

Further, if it needs to progressively drive the driving circuit for the respective pixels, that is, a pre-charging to a next row can only be done after the pre-charging to a previous row is completed, the embodiment of the present disclosure can further provide an alternative way to achieve the progressive driving. That is, the gate and/or the drain of the first TFT 501 can be connected to the input terminal of the pre-charging control voltage Vselect and the current input terminal through a TFT operating as a switch. The TFT operating as the switch is turned on at a high level and is turned off at a low level. Therefore, different signals are input from the input terminal of the pre-charging control voltage Vselect of the respective rows of the pixel circuits to realize the progressive driving.

Specifically, the gate of the first TFT 501 can be connected to the input terminal of the pre-charging control voltage Vselect and the current input terminal through a TFT operating as a switch.

Figure 7:
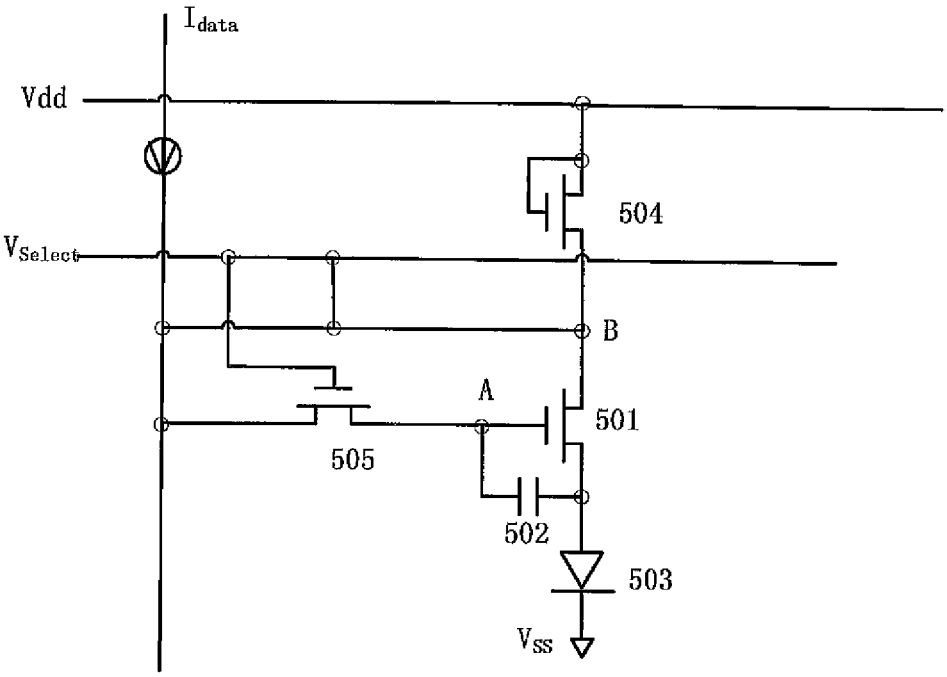
FIG. 7 is a schematic diagram of a pixel circuit in a third embodiment of the present disclosure.

FIG. 7 shows a pixel circuit of a third embodiment of the present disclosure schematically. As shown in FIG. 7, the gate of the first TFT 501 may be connected to the input terminal of the pre-charging control voltage Vselect and the current input terminal through a TFT operating as a switch.

More specifically, the gate of the first TFT 501 is connected to the input terminal of the pre-charging control voltage Vs elect and the current input terminal through a third TFT 505. The gate of the third TFT 505 is connected to the input terminal of the pre-charging control voltage Vselect, one of a source and a drain thereof is connected to the gate of the first TFT 501, and the other one of the source and the drain is connected to the current input terminal.

Further, the drain of the first TFT 501 may also be connected to the input terminal of the pre-charging control voltage Vselect and the current input terminal through a TFT operating as a switch.

Figure 8:
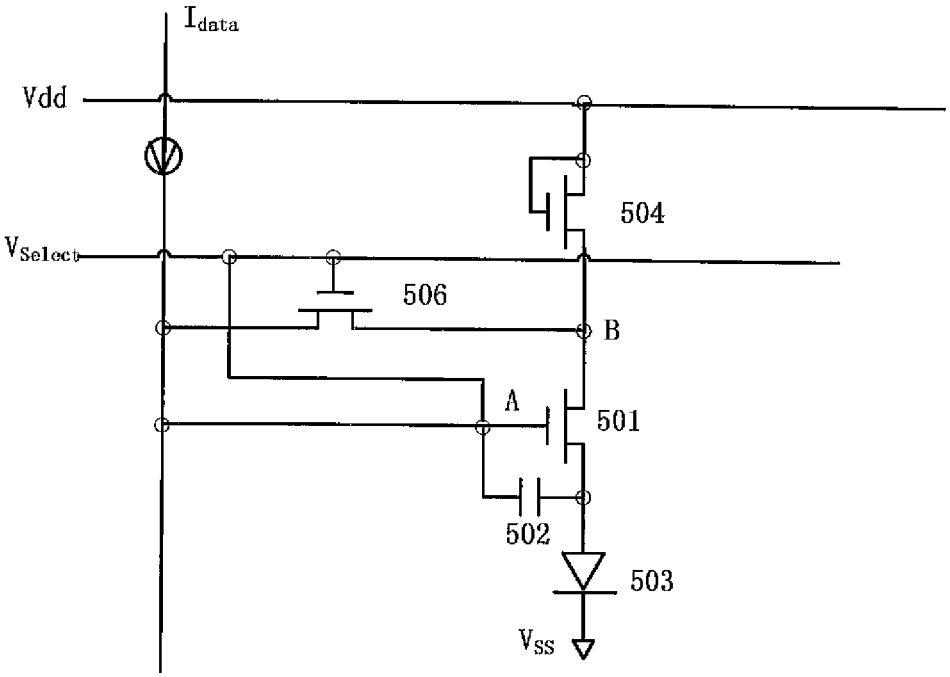
FIG. 8 is a schematic diagram of a pixel circuit in a fourth embodiment of the present disclosure.

FIG. 8 shows a diagram of a pixel circuit in a fourth embodiment of the present disclosure schematically. As shown in FIG. 8, the drain of the first TFT 501 is connected to the input terminal of the pre-charging control voltage Vselect and the current input terminal through a TFT operating as a switch.

More specifically, the drain of the first TFT is connected to the input terminal of the pre-charging control voltage Vselect and the current input terminal through a fourth TFT 506. A gate of the fourth TFT 506 is connected to the input terminal of the pre-charging control voltage Vselect, one of a source and a drain is connected to the drain of the first TFT 501, and the other one of the source and the drain is connected to the current input terminal.

Of course, those skilled in the art may also employ other feasible ways to achieve the progressive driving for the pixel circuits. The implementation provided here is only exemplary, and the other implementations will not be described in detail one by one.

Figure 9:
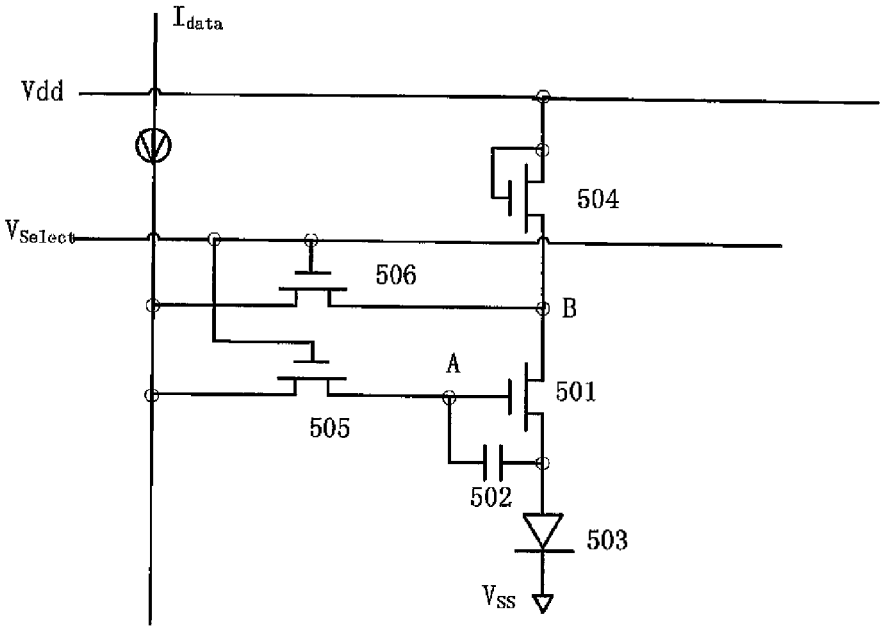
FIG. 9 is a schematic diagram of a pixel circuit in a fifth embodiment of the present disclosure.

FIG. 9 shows a pixel circuit in a fifth embodiment of the present disclosure schematically. As shown in FIG. 9, an alternative pixel circuit in the embodiment of the present disclosure comprises: a first TFT 501, a second TFT 504, a third TFT 505 and a fourth TFT 506, and further comprises a capacitor 502 and a OLED 503.

Herein two ends of the capacitor 502 are connected to a source and a gate of the first TFT 501, respectively.

A positive pole of the OLED 503 is connected to the source of the first TFT 501, and the negative pole of the OLED 503 is connected to an input terminal of a ground voltage Vss.

A gate and one of a source and a drain of the second TFT 504 are connected to an input terminal of a light emitting operation voltage Vdd, and the other one of the source and the drain is connected to a drain of the first TFT 501.

A gate of the third TFT 505 is connected to an input terminal of a pre-charging control voltage Vselect, one of a source and a drain of the third TFT 505 is connected to the gate of the first TFT 501, and the other one of the source and the drain is connected to the current input terminal.

A gate of the fourth TFT 506 is connected to the input terminal of the pre-charging control voltage Vselect, one of a source and a drain of the fourth TFT 506 is connected to the drain of the first TFT 501, and the other one of the source and the drain is connected to the current input terminal.

Here, an inverse signal synchronized with the pre-charging control voltage Vselect is input from the input terminal of the light emitting operation voltage Vdd. The circuit is supplied with the voltage by the pre-charging control voltage Vselect when the pixel circuit enters the pre-charging stage, and is supplied with the voltage by the light emitting operation voltage Vdd when the pixel circuit enters the light emitting stage to ensure the current output of the circuit at the pre-charging stage and the light emitting stage. Also, there is no external voltage input terminal which will affect the aperture ratio, thereby increasing the aperture ratio of the OLED employing the current-driven pixel circuit, and further increasing the lifetime of the OLED employing the current-driven pixel circuit. The second TFT 504 may be viewed as a diode with a positive pole being connected to the input terminal of the light emitting operation voltage Vdd and a negative pole being connected to the drain of the first TFT 501, thereby ensuring that the direction of the current in the driving circuit is from the input terminal of the light emitting operation voltage Vdd to the drain of the first TFT 501. The third TFT 505 and the fourth TFT 506 are TFTs operating as switch, which are turned on at the high level and turned off at the low level, thereby inputting different signals by the input terminal of the pre-charging control voltage Vselect of the respective rows of the pixel circuits, so as to achieve the progressive driving.

There further provides in the embodiment of the present disclosure a driving circuit comprising multiple pixel circuits provided in the embodiments of the present disclosure being formed in a matrix.

The pixel circuits in the same row of the matrix among the multiple pixel circuits provided in the embodiments of the present disclosure are connected to the same input terminal of the light emitting operation voltage, and are connected to the same input terminal of the pre-charging control voltage.

The pixel circuits in the same column of the matrix among the multiple pixel circuits provided in the embodiments of the present disclosure are connected to the same current input terminal.

Figure 10:
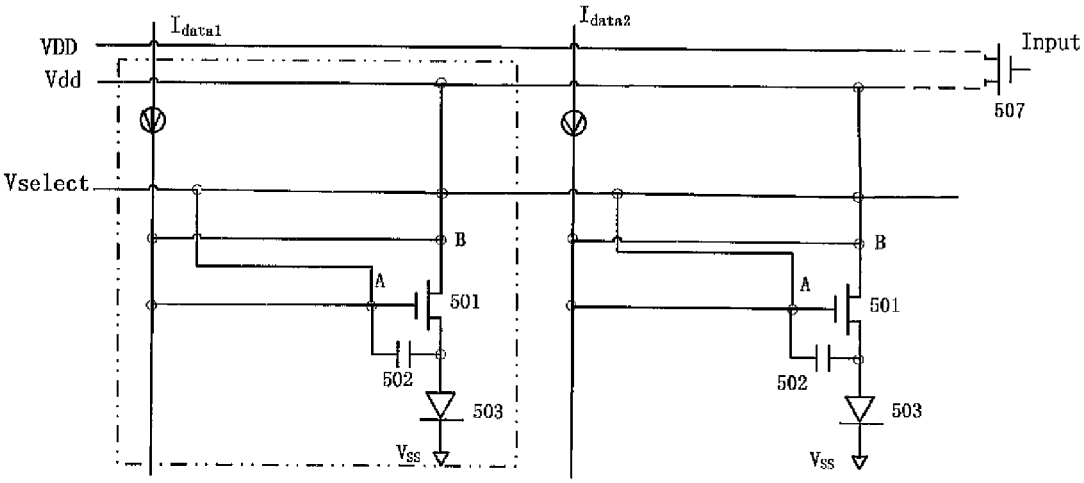
FIG. 10 is a schematic diagram of a driving circuit in an embodiment of the present disclosure.

FIG. 10 shows a driving circuit in an embodiment of the present disclosure schematically. Alternatively, as shown in FIG. 10, the driving circuit provided in the embodiment of the present disclosure comprises multiple pixel circuits forming a matrix. In FIG. 10, the pixel circuits in the first column of the matrix among the multiple pixel circuits provided in the embodiment of the present disclosure comprises a fifth TFT 507.

A source and a drain of the fifth TFT 507 are connected to the input terminal of the light emitting operation voltage Vdd and an input terminal of an operation voltage VDD respectively, a gate of the fifth TFT 507 is connected to a signal input terminal Input for inputting an inverse signal synchronized with the pre-charging control voltage Vselect, and the fifth TFT 507 is a N-type TFT.

The fifth TFT 507 is arranged in the pixel circuits in the first column of the matrix among the multiple pixel circuits provided in the embodiment of the present disclosure. By inputting an inverse signal synchronized with the pre-charging control voltage Vselect at the gate of the fifth TFT 507 and connecting the input terminal of the light emitting operation voltage Vdd and the input terminal of the operation voltage VDD at the source and the drain thereof respectively, the signal output from one of the source and the drain of the fifth TFT 507 which is connected to the input terminal of the light emitting operation voltage Vdd is the signal input to the pixel circuits from the input terminal of the light emitting operation voltage Vdd. After the signal is input from the input terminal of the operation voltage VDD and the input terminal of the pre-charging control voltage Vselect, signal output from the one of the source and the drain of the fifth TFT 507 which is connected to the input terminal of the light emitting operation voltage Vdd is the inverse signal synchronized with the pre-charging control voltage Vselect, thereby ensuring that the signal input to the pixel circuits from the input terminal of the light emitting operation voltage Vdd is the inverse signal synchronized with the pre-charging control voltage Vselect.

Of course, those skilled in the art may employ other feasible ways to ensure that the signal input to the pixel circuits from the input terminal of the light emitting operation voltage Vdd is the inverse signal synchronized with the pre-charging control voltage Vselect. The implementation provided here is only exemplary, and the other implementations will not be described in detail one by one.

Figure 11:
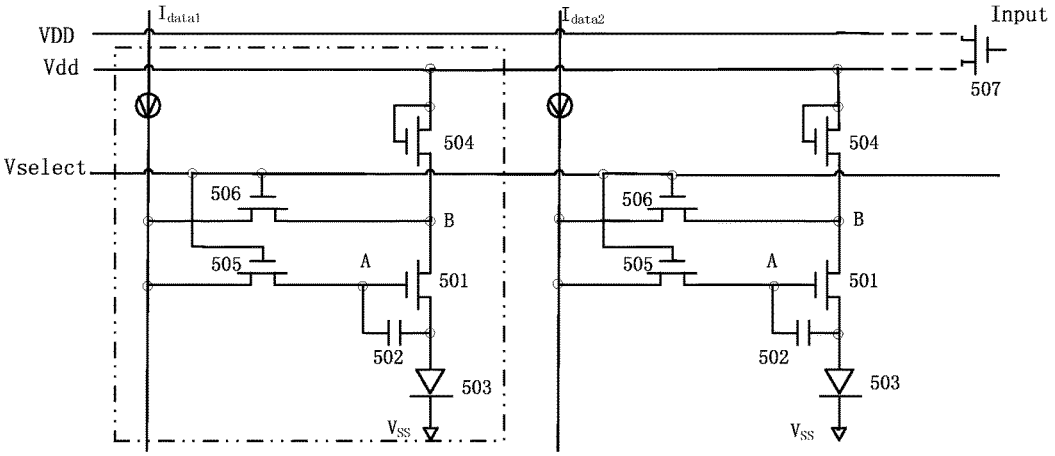
FIG. 11 is a schematic diagram of an alternative driving circuit in the embodiment of the present disclosure.

FIG. 11 shows an alternative driving circuit in the embodiment of the present disclosure. As shown in FIG. 11, there is provided in the embodiment of the present disclosure an exemplary driving circuit, which comprises multiple pixel circuits forming a matrix.

The pixel circuit comprises: a first TFT 501, a second TFT 504, a third TFT 505, a fourth TFT 506 and a fifth TFT 507, and further comprises a capacitor 502 and a OLED 503.

Two ends of the capacitor 502 are connected to a source and a gate of the first TFT 501, respectively.

A positive pole of the OLED 503 is connected to the source of the first TFT 501, and the negative pole of the OLED 503 is connected to an input terminal of a ground voltage Vss.

A gate and one of a source and a drain of the second TFT 504 are connected to an input terminal of a light emitting operation voltage Vdd, and the other one of the source and the drain is connected to a drain of the first TFT 501.

A gate of the third TFT 505 is connected to an input terminal of a pre-charging control voltage Vselect, one of a source and a drain of the third TFT 505 is connected to the gate of the first TFT 501, and the other one of the source and the drain is connected to the current input terminal.

A gate of the fourth TFT 506 is connected to the input terminal of the pre-charging control voltage Vselect, one of a source and a drain of the fourth TFT 506 is connected to the drain of the first TFT 501, and the other one of the source and the drain is connected to the current input terminal.

Figure 12:
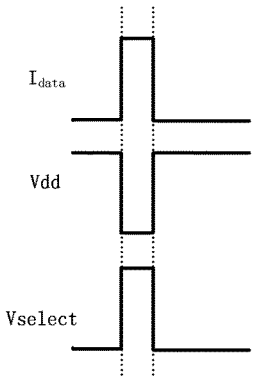
FIG. 12 is a simulated waveform chart of an input voltage in the embodiment of the present disclosure.

A source and a drain of the fifth TFT 507 in the pixel circuits of the first column of the matrix among the multiple pixel circuits are connected respectively to the input terminal of the light emitting operation voltage Vdd and an input terminal of an operation voltage VDD. A gate of the fifth TFT 507 is connected to a signal input terminal Input for inputting an inverse signal synchronized with the pre-charging control voltage Vselect, and the fifth TFT 507 is a N-type TFT. Exemplarily, as shown in FIG. 12, the signal input from the input terminal of the operation voltage VDD may also be opposite to the signal input from the input terminal of the pre-charging control voltage Vselect.

The pixel circuits in the same row of the matrix among the multiple pixel circuits are connected to the same input terminal of the light emitting operation voltage, and are connected to the same input terminal of the pre-charging control voltage.

The pixel circuits in the same column of the matrix among the multiple pixel circuits are connected to the same current input terminal.

In the following, the operation principle of the driving circuit shown in FIG. 11 will be described by way of example in detail.

Figure 13:
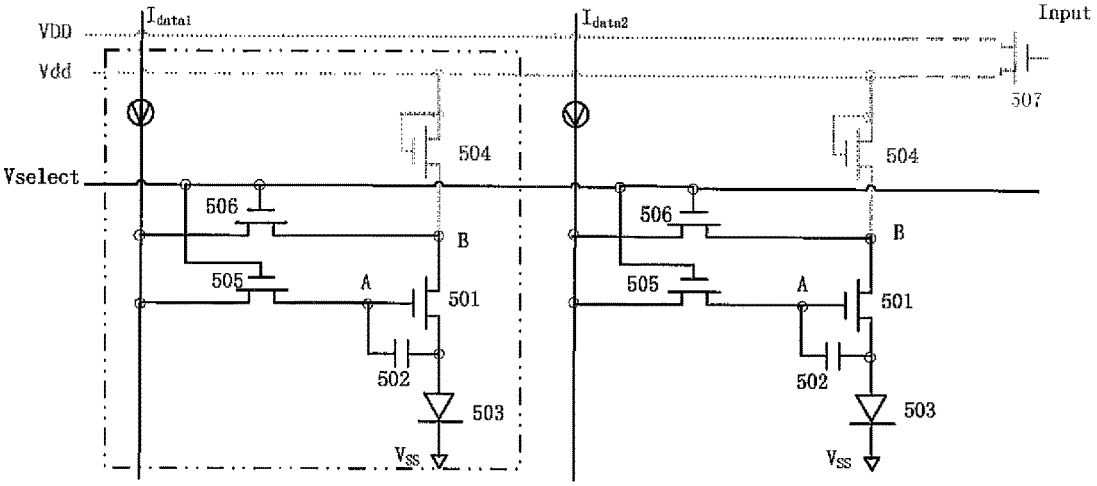
FIG. 13 is a schematic circuit diagram of the driving circuit in a pre-charging stage in the embodiment of the present disclosure.

FIG. 13 shows schematically a circuit in the pre-charging stage of the driving circuit according to the embodiment of the present disclosure. As shown in FIG. 13, in the pre-charging stage, the pre-charging control voltage Vselect is the high level, and the light emitting operation voltage Vdd is the low level. At this time, the fifth TFT 507 and the second TFT 504 are turned off, and the third TFT 505 and the fourth TFT 506 are turned on. The voltages at the gate (point A) and the drain (point B) of the first TFT 501 are equal, Vds>Vgs-Vth, where Vds is the source-drain voltage and Vgs is the source-gate voltage. At this time, the first TFT 501 is in the saturated region, the current Idata is flowed into the first TFT 501 through the fourth TFT 506, the capacitor 502 stores charges to maintain the source-gate voltage Vgs of the first TFT 501, and the output current $I_{OLED}$ is equal to Idata at this time.

Figure 14:
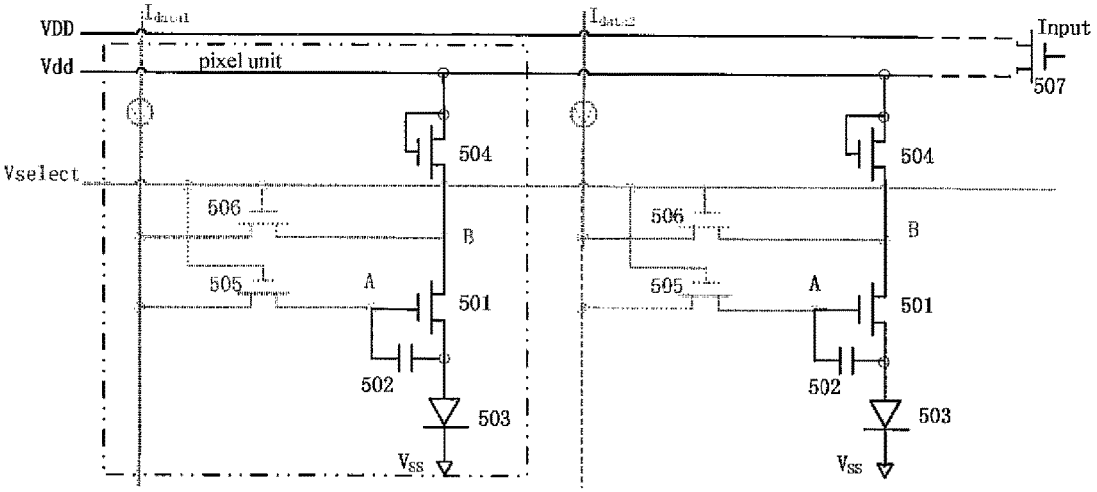
FIG. 14 is a schematic circuit diagram of the driving circuit in a light emitting stage in the embodiment of the present disclosure.

FIG. 14 shows schematically a circuit in the light emitting stage of the driving circuit according to the embodiment of the present disclosure. As shown in FIG. 14, in the light emitting stage, the pre-charging control voltage Vselect is the low level, and the light emitting operation voltage Vdd is the high level. At this time, the third TFT 505 and the fourth TFT 506 are turned off, and the second TFT 504 and the fifth TFT 507 are turned on. The voltage at the drain (point B) of the first TFT 501 is the high level. The first TFT 501 is still in the saturated region, the output current of the transistor at this time will maintain the value when the transistor enters the saturated region. Therefore, the output current $I_{OLED}$ in the light emitting stage is still Idata in the pre-charging stage, and the output current remains unchanged.

It can be known that the output current of the driving circuit shown in FIG. 11 is only related to the input current, and is unrelated with the threshold voltage Vth. Therefore, the effect of the non-uniformity of the threshold voltage on the display is basically eliminated, the output current is stable, and it is easy to realize a high brightness and a high resolution of the display.

Figure 15:
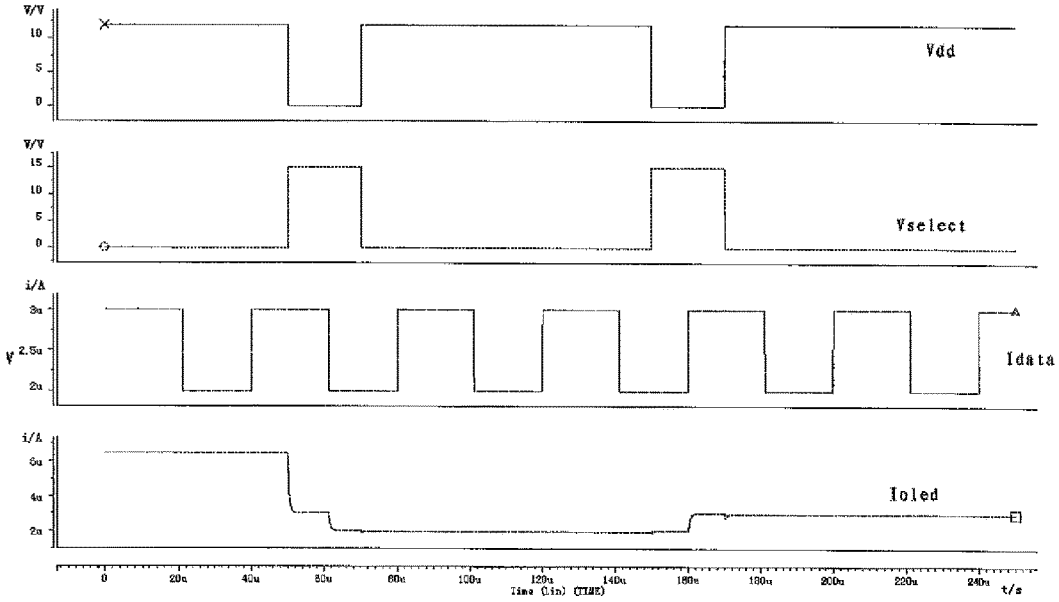
FIG. 15 is a simulated signal waveform chart of an operation process of the driving circuit in the embodiment of the present disclosure.

FIG. 15 shows a simulated signal waveform chart of the operation process of the driving circuit in the embodiment of the present disclosure. FIG. 15 is a simulation result of the driving circuit shown in FIG. 11. The simulation shows two operation cycles of a single sub pixel. In the first cycle, the pixel is written with the current of 2 uA. In the second cycle, the pixel is written with the current of 3 uA. It can be seen obviously from the waveform chart that the output current $I_{OLED}$ of the pixel follows the change of the input current Idata very well, after the circuit is pre-charged.

There is further provided in the embodiment of the present disclosure an array substrate comprising the driving circuit provided in the embodiments of the present disclosure.

There is provided in the embodiment of the present disclosure a display device comprising the driving circuit provided in the embodiments of the present disclosure.

The embodiments of the present disclosure provide a pixel circuit, a driving circuit, an array substrate and a display device, which are supplied with the voltage by the light emitting operation voltage Vdd when the pixel circuit enters the light emitting stage, by inputting an inverse signal synchronized with the pre-charging control voltage Vselect at the input terminal of the light emitting operation voltage Vdd to ensure a stable output of the current by the circuit at the light emitting stage. Also, there is no external voltage input terminal which will affect the aperture ratio, thereby increasing the aperture ratio of the OLED employing the current-driven pixel circuit while ensuring the stable output of the current by the current-driven circuit, and thus increasing the lifetime of the OLED employing the current-driven pixel circuit.

Obviously, those skilled in the art can make modifications and variations to the embodiments of the present disclosure without departing from the spirit and the scope of the present disclosure. Hence, it is intended to include these modifications and variations in the present disclosure as long as these modifications and variations belong to the scope of the claims of the present disclosure and the equivalents thereto.

What is claimed is:

1. A pixel circuit, comprising:

at least one of a gate and a drain of a first thin film transistor being directly connected to both an input terminal of a pre-charging control voltage and a current input terminal;

a second thin film transistor whose gate is directly connected to one of a source and a drain thereof, wherein the gate and said one of the source and the drain of the second thin film transistor are both connected to an input terminal of a light emitting operation voltage for inputting a light emitting operation voltage synchronized with and inverted compared to the pre-charging control voltage, and the other one of the source and the drain of the second thin film transistor is connected to the drain of the first thin film transistor;

a capacitor whose two ends are connected to a source and the gate of the first thin film transistor, respectively; and an organic light emitting diode whose positive pole is connected to the source of the first thin film transistor, and negative pole is connected to an input terminal of a ground voltage, wherein one end of the capacitor and the positive pole of the organic light emitting diode are directly connected.

2. The circuit of claim 1, wherein when the drain of the first thin film transistor is directly connected to the input terminal of the pre-charging control voltage and the current input terminal, the gate of the first thin film transistor is connected to the input terminal of the pre-charging control voltage and the current input terminal through a thin film transistor operating as a switch.

3. The circuit of claim 2, wherein the gate of the first thin film transistor is connected to the input terminal of the pre-charging control voltage and the current input terminal, through a third thin film transistor whose gate is connected to the input terminal of the pre-charging control voltage, one of source and drain is connected to the gate of the first thin film transistor, and the other one of source and drain is connected to the current input terminal.

4. The circuit of claim 3, wherein the input terminal of the pre-charging control voltage is directly connected to the current input terminal.

5. The circuit of claim 1, wherein when the gate of the first thin film transistor is directly connected to the input terminal of the pre-charging control voltage and the current input terminal, the drain of the first thin film transistor is connected to the input terminal of the pre-charging control voltage and the current input terminal through a thin film transistor operating as a switch.

6. The circuit of claim 5, wherein the drain of the first thin film transistor is connected to the input terminal of the pre-charging control voltage and the current input terminal, through a fourth thin film transistor whose gate is connected to the input terminal of the pre-charging control voltage, one of source and drain is connected to the drain of the first thin film transistor, and the other one of source and drain is connected to the current input terminal.

7. The circuit of claim 6, wherein the other end of the capacitor is directly connected to the input terminal of the pre-charging control voltage and the current input terminal.

8. A driving circuit comprising multiple pixel circuits of claim 1 formed in a matrix;

wherein the pixel circuits in the same row of the matrix among the multiple pixel circuits are connected to the same input terminal of the light emitting operation voltage, and are connected to the same input terminal of the pre-charging control voltage; and the pixel circuits in the same column of the matrix among the multiple pixel circuits are connected to the same current input terminal.

9. The driving circuit of claim 8, wherein the pixel circuits in a first column of the matrix among the multiple pixel circuits of claim 1 comprise a fifth thin film transistor;

a source and a drain of the fifth thin film transistor are connected to the input terminal of the light emitting operation voltage and an input terminal of an operation voltage respectively, and a gate thereof is connected to a signal input terminal for inputting an inverse signal synchronized with the pre-charging control voltage, and the fifth thin film transistor is a N-type thin film transistor.

10. An array substrate comprising the driving circuit of claim 8.

11. The array substrate of claim 10, wherein the pixel circuits in a first column of the matrix among the multiple pixel circuits comprise a fifth thin film transistor;

a source and a drain of the fifth thin film transistor are connected to the input terminal of the light emitting operation voltage and an input terminal of an operation voltage respectively, and a gate thereof is connected to a signal input terminal for inputting an inverse signal synchronized with the pre-charging control voltage, and the fifth thin film transistor is a N-type thin film transistor.

12. The driving circuit of claim 8, wherein when the drain of the first thin film transistor is directly connected to the input terminal of the pre-charging control voltage and the current input terminal, the gate of the first thin film transistor is connected to the input terminal of the pre-charging control voltage and the current input terminal through a thin film transistor operating as a switch.

13. The driving circuit of claim 12, wherein the gate of the first thin film transistor is connected to the input terminal of the pre-charging control voltage and the current input terminal, through a third thin film transistor whose gate is connected to the input terminal of the pre-charging control voltage, one of source and drain is connected to the gate of the first thin film transistor, and the other one of source and drain is connected to the current input terminal.

14. The driving circuit of claim 8, wherein when the gate of the first thin film transistor is directly connected to the input terminal of the pre-charging control voltage and the current input terminal, the drain of the first thin film transistor is connected to the input terminal of the pre-charging control voltage and the current input terminal through a thin film transistor operating as a switch.

15. The driving circuit of claim 14, wherein the drain of the first thin film transistor is connected to the input terminal of the pre-charging control voltage and the current input terminal, through a fourth thin film transistor whose gate is connected to the input terminal of the pre-charging control voltage, one of source and drain is connected to the drain of the first thin film transistor, and the other one of source and drain is connected to the current input terminal.

16. The circuit of claim 1, wherein when both the gate and the drain of the first thin film transistor are directly connected to the input terminal of the pre-charging control voltage and the current input terminal, the other end of the capacitor is directly connected to the input terminal of the pre-charging control voltage and the current input terminal, and the input terminal of the pre-charging control voltage is directly connected to the current input terminal.

* * * * *